United States Patent [19]

Lubin et al.

[11] Patent Number: 4,665,778

[45] Date of Patent: May 19, 1987

[54] TORQUE LOADED SKI TUNING DEVICE

[75] Inventors: Mark Lubin, Aurora; Jeffrey I. Mulnick, Longmont, both of Colo.

[73] Assignee: Flying Camel, Ltd., Boulder, Colo.

[21] Appl. No.: 846,000

[22] Filed: Mar. 31, 1986

[51] Int. Cl.[4] ..... A63C 11/06

[52] U.S. Cl. ..... 76/83; 29/80; 51/205 WG

[58] Field of Search ..... 76/83, 82, 88; 29/78, 29/80; 51/205 WG, 214

[56] References Cited

U.S. PATENT DOCUMENTS

| | | | |
|---|---|---|---|
| 3,670,601 | 6/1972 | Weeks | 76/83 |
| 3,834,250 | 9/1974 | Fonas | 76/83 |
| 3,875,825 | 4/1975 | Buttafuco | 76/83 |
| 3,934,287 | 1/1976 | Howard | 51/205 WG |
| 4,060,013 | 11/1977 | Thompson | 76/83 |

*Primary Examiner*—Roscoe V. Parker

*Attorney, Agent, or Firm*—Donald W. Margolis

[57] ABSTRACT

A device for sharpening skis having metal edges is disclosed. The device employs at least two spaced apart edge sharpening tools, such as files, which straddle the ski edges. Each file is connected to a constant torque device. In this manner the edge sharpening tools are automatically brought into continuous contact with the lateral surfaces of the metal edges of the ski with an equal and constant pressure which is not dependent on the user's skills. In preferred embodiments the side files are symmetrically mounted, for example on rotatable arms so that regardless of the lateral pressure applied by the user while sliding the tool longitudinally on the ski, a uniform sharpening and filing pressure is applied to the entire length of the ski edge. The device also provides a support and positioning function for one or more smoothing tool, such as a flat file, which extends transversely across the bottom of the ski as the device is moved longitudinally along the ski. Such smoothing tools provide a simultaneous shaving and smoothing action to the bottom of the ski without having a tendency to dig or gouge into its bottom surface.

16 Claims, 2 Drawing Figures

TORQUE LOADED SKI TUNING DEVICE

BACKGROUND OF THE INVENTION a. Field of the Invention

The present invention relates to tools which have a metal portion which is useful for sharpening other tools. More particularly, the invention relates to a tool for use in tuning ski bottoms and in sharpening ski edges, which tool utilizes multiple sharpening devices and guide means.

b. Discussion of the Prior Art

Downhill skiing has become a very popular activity, with millions of skiers using the ski slopes numerous times every ski season. As the popularity of the sport has increased, the quality and complexity of downhill skis has been increased.

Skis require constant maintenance in order for them to preserve or maintain a good degree of maneuverability and safety. Most present-day skis are constructed with longitudinal, bottom metal edges which are L-shaped in configuration and which extend along the side edges and the bottom surface adjacent the edge of the ski. These L-shaped edges are arranged so that their vertical side portions extend at least partially up the longitudinal side surfaces of the ski, and so that their horizontal bottom portions extend inwards towards one another along the bottom of the ski. The space on the bottom of the ski between the bottom metal portions is usually quite extensive in width, and is most often constructed of plastic, plastic-composite materials, or wood. It is current practice to normally apply a coating of wax to the bottom surface of the ski in order to reduce or control friction between the ski and the snow, and also as a form of protection to the bottom of the ski. After repeated use of such a ski, the metal edges tend to become dull and often become nicked, and the ski bottom becomes scratched and may also assume a concave contour along its transverse cross-section. Were it not for the ability to "tune" or recondition the bottom and edges of the ski, the user would be burdened by decreased and decreasing performance, evidenced, for example, by reduced turning ability and downhill speed. In addition, the bottom would eventually require major reconditioning and the metal edges would require complete replacement from time to time.

Ski reconditioning techniques and tools currently exist. However, such tools in the hands of an experienced user consume considerable amounts of time, and often require special fixtures for holding the skis in place during such reconditioning. Currently, ski reconditioning most often requires the use of many separate tools and materials, such as files, cutters, routers, planes, cork, meltable plastic, and wax. Such tools and materials in the hands of the inexperienced user may result in unsatisfactory tuning, or even in permanent damage to the ski and potential danger to the ski user.

There are on the market at the present time, and there have been designed and patented in the past, a number of ski conditioning tools, including files or cutters which may be slid along the side surface of a ski's metal edges, and which provide the necessary support to effect a substantially vertical cutting or filing operation in order to sharpen the metal side edges. Such tools have also included separately or in combination, scraper bars, strips or files which ride on the bottom surfaces of the ski and the bottom surfaces of the L-shaped metal runners with the intention of leveling the bottom of the ski while simultaneously sharpening the bottom portion of the metal edges.

Several ski repair and tuning devices are disclosed by the prior art. U.S. Pat. No. 3,670,601 discloses a ski sharpening device which provides a flat platform for a portion of the skis with a file positioned at right angles to the platform. While this device provides some degree of assistance in maintaining the edge of the file perpendicular to the edge of the ski during sharpening, it fails to provide any means for tuning the bottom of the ski or for removing burrs from the metal edges. U.S. Pat. No. 3,834,250 discloses a method and device for tuning a pair of skis with a tuning device which incorporates side and bottom edge files and a scraping tool, utilized in conjunction with a unit for holding a pair of skis in a selected position. U.S. Pat. No. 3,875,825 discloses a device for sharpening the edges of a ski while smoothing its bottom. The device of this latter patent includes a central well portion which carries a flat file which can fit over the bottom of the ski. It also includes a resiliently mounted edge file in opposed sidewalls of the well. This causes the edge file blades to be resiliently urged against the edges of the metal strip at the bottom of a ski. In this latter patent the resilient means for urging the files against the edges of the skis are taught to be of the coil spring type which urge the files against the metal edges with varying amounts of force, depending upon the condition of the spring and the amount of expansion or compaction of the spring.

U.S. Pat. No. 3,934,287 discloses a combined ski maintenance tool which carries a flat file in one portion, a scraping blade in another portion, and a cork smoothing block in yet another portion. This tool allows the convenient selection of each portion as it is required for use in the tuning and maintenance of a ski. The tool of this latter reference also provides means for maintaining the file flat or perpendicular, as required for use in scraping the bottom of the ski or filing the edge of the ski. The degree of pressure applied during edge filing is controlled by the operator. U.S. Pat. No. 4,060,013 discloses a tool adapted for renovating or conditioning skis by sharpening the bottom and side surfaces, which tool includes an elongated body having a pair of spaced apart shaving strips extending along its bottom side and a pair of shaving blocks near its opposite end, which shaving blocks are spaced apart a greater distance than the maximum width of any ski. This device is hand operated so that the operator controls the degree of pressure which is applied to the edges during sharpening.

Such ski conditioning tools have not proven altogether satisfactory, with the principal limitation being the necessity of using great care and skill in the application of filing or cutting pressure in order to prevent localized digging or gouging of the bottom or edges of the ski by the files, cutter or scrapers. As discussed above, some such tools have taken care of the exposed side surfaces of the overhanging vertical part of the metal edge, while others take care of the bottom surface of the ski. A few such tools have been intended to perform both functions simultaneously. Nevertheless, all of them require special skills, or necessitate special fixtures (other than a vise) for holding the skis stationary while operating the tools, or otherwise put their users to a demanding task in the proper use of the tools. Finally, none of these known tools is designed to operate to automatically apply constant pressure to edge sharpening tools on opposite side surfaces of the metal edges of the skis.

SUMMARY OF THE INVENTION

The present invention is designed to overcome the above noted limitations that are attendent upon the construction and use of the prior art and present-day ski conditioning tools. Towards this end, the invention contemplates provision of a novel tool which, insofar as conditioning the side surfaces of the L-shaped metal edges, employs at least two spaced apart edge sharpening tools, such as files, which straddle the ski edges and which are connected to a constant torque device in such a manner that the edge sharpening tools are automatically brought into continuous contact with the lateral surfaces of the metal edges of the ski with an equal and constant pressure which is not dependent on the user's skills. Moreover, the side files are symmetrically mounted, for example on rotatable arms so that regardless of the lateral pressure applied by the user while sliding the tool longitudinally on the ski a uniform sharpening and filing action is applied to the entire ski edge.

With respect to the conditioning of both the bottom surfaces of the L-shaped metal edge and the bottom surface of the extensive material between the running edges, the tool provides a support and positioning function for one or more flat file which extends transversely across the bottom of the ski. As the tool of the present invention is moved longitudinally along the ski from tip to tail, such flat bottom files provide a shaving and filing action without having a tendency to dig or gouge into the bottom surface of this ski. Moreover, the tool is ergonomically designed to make the application of a correct amount of pressure to the base of the ski both simple and reproducable, even for an unskilled operator.

The provision of ski-conditioning tools such as set forth above and possessing the stated advantages, constitutes the principal object of the principal invention.

These and other objects of the present invention will become apparent to those skilled in the art from the following detailed description, showing the contemplated novel construction, combination, and arrangement of parts as herein described, and more particularly defined by the appended claims, it being understood that changes in the precise embodiments of the herein disclosed invention are meant to be included as come within the scope of the claims, except insofar as precluded by the prior art.

BRIEF DESCRIPTION OF THE DRAWINGS

The accompanying drawings illustrate complete preferred embodiments of the present invention according to the best mode presently devised for the practical application of the principles thereof, and in which.

DETAILED DESCRIPTION OF THE INVENTION

Figure 2:
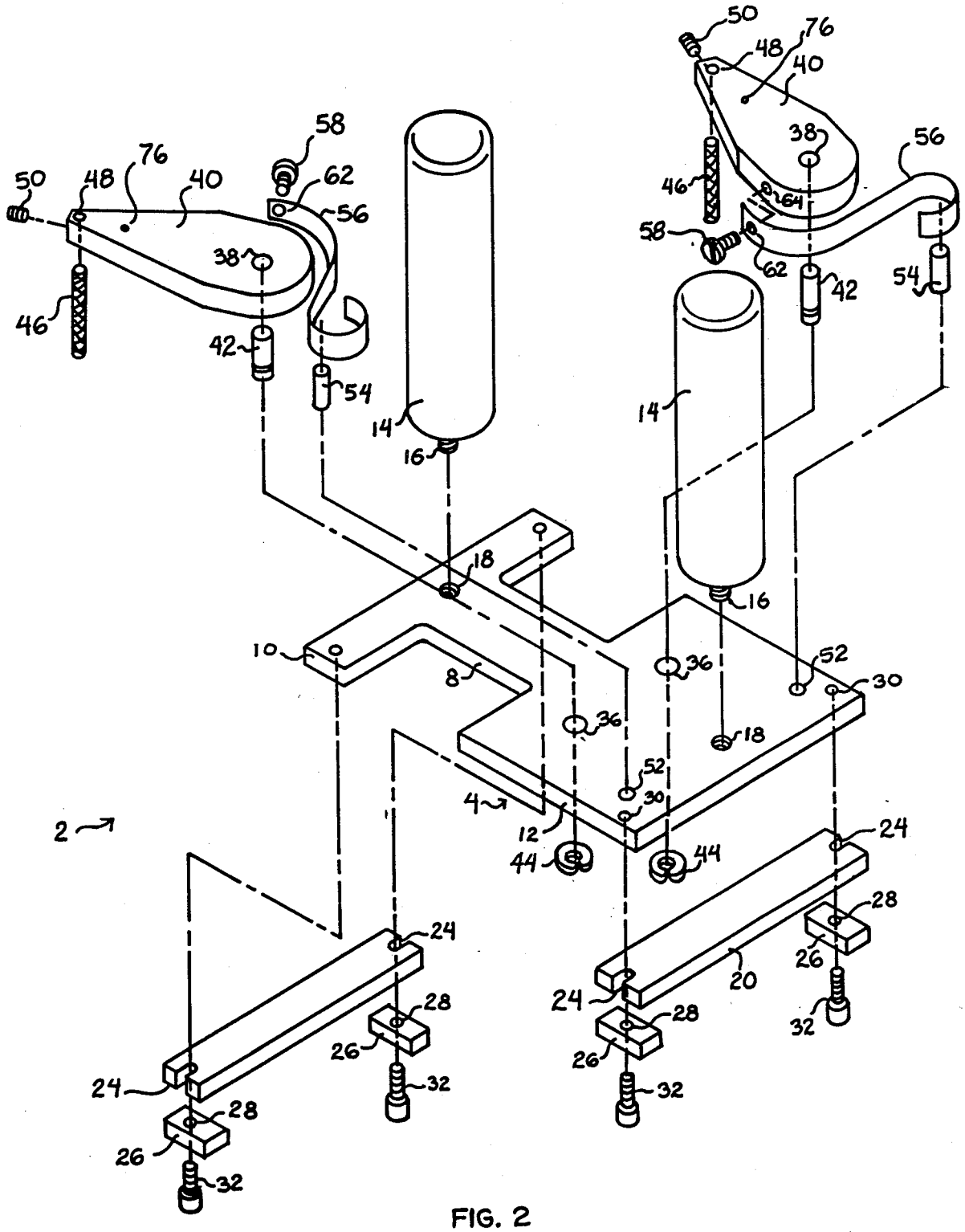
FIG. 2 is an exploded perspective view detailing the relationship between the various parts of the ski tuning device of FIG. 1.

Now, referring to the drawings, the ski tuning device of the present invention, generally 2, will include a complex I-shaped base plate 4. As best seen in exploded FIG. 2, base plate 4 includes an indented central body portion 8 and a pair of legs 10 and 12. Legs 10 and 12 are parallel and opposed to one another at opposite ends of central body portion 8 and perpendicular to its centerline. A pair of spaced apart parallel upright handles 14 having threaded studs 16 at their lower ends will be removably connected perpendicular to the upper surface of base plate 4. Threaded studs 16 of handles 14 will be mounted within threaded holes 18 located along the centerlines of baseplate 4. Handles 14 will be capable of easy removal from the device, for example for storage.

A pair of rectangular flat files 20 will be replacably located on the lower surface of base plate 4 along the outer transverse edge surfaces of legs 10 and 12. Each file 20 will include a pair of notches 24 at their opposed longitudinal ends. Skew blocks 26, including screw holes 28, will be located at each end corner of legs 10 and 12, below files 20. Legs 10 and 12 will carry screw holes 30 at each end. Screw holes 30 in legs 10 and 12, file notches 24 and screw holes 28 in skew blocks 26 will all be in stacked registration with one another, and by the use of attaching means such as screws 32 a composite laminate of skew block 26, flat file 20 and the base plate will be formed at the end corners of legs 10 and 12. It will be noted that flat files 20 will thus be capable of removal and replacement by removal of screws 32.

Referring again to base plate 4, it will be noted that leg 12 will include a pair of pivot holes 36. Rotably mounted on leg 12 will be a pair of edge sharpening structures which will include a pair of arms 40 which will be pivotably mounted on leg 12 of base plate 4 by means of a pair of pivot pins 42. Pivot pins 42 will be press-fit pass through holes 38 in arms 40 and snug clearance fit through pivot holes 36 to pivotably connect arms 40 to base plate 4. A retaining ring 44 will be connected to the lower end of each pivot pin 42 at the lower surface of base plate 4 to secure pivot pins 42 and attached press-fit arms 40 to the upper surface of base plate 4. This will allow arms 40 to rotate in a plane parallel to and adjacent to the plane of base plate 4.

Mounted on the distal end of each arm 40 will be a cylindrical side file 46. Each file 46 will be inserted within hole 48 of arm 40 and removably secured in place by means of set screw 50 extending through a lateral set screw hole in the end of the arm, not shown. The edge sharpening structure will be such that each side file 46 extends downwardly and will be oriented at a substantially 90° angle from its associated arm 40, and also at a substantially 90° angle to base plate 4. The axial length of side files 46 will be such that they extend almost as far below base plate 4 as the lower surface of skew blocks 26.

Leg 12 of base 4 will also include a pair of holes 52 into which bottom threaded spring tension pins 54 will be secured by a press fit. A pair of constant force springs 56 will be connected to the medial portions of arms 40 by means of screws 58. Screws 58 will extend through holes 62 in springs 56 and into holes 64 in the medial surfaces of arms 40. Each constant-force spring 56 will be, for example, of the prestressed flat blade type. Each spring 56 will be configured to extend around its associated spring tension pin 54, so that each spring 56 will be bent against its natural curvature at its line of contact with its associated pin 54. This will result in each spring providing a constant torque to its associated arm 40 around pivot pin 42.

Figure 1:
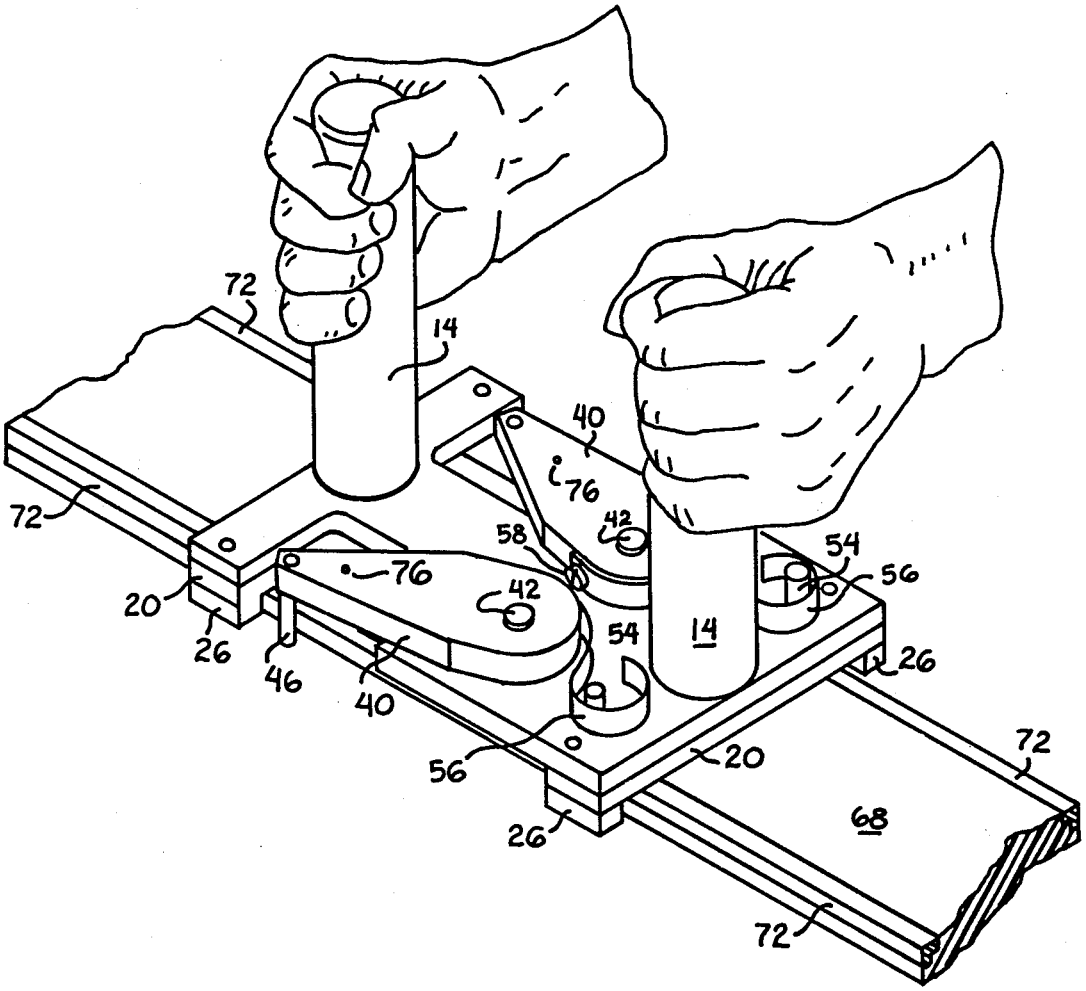
FIG. 1 is a perspective view of the preferred embodiment of the torque loaded ski tuning device of the present invention, illustrating it in place on a ski which is shown partially in section.

Now, it may be seen that a system which is so connected and so designed will provide a device in which rectangular flat files 20 will be substantially at right angles to side files 46. In operation, when being used to tune a ski, flat files 20 will first be located so that they rest on the bottom portion 68 of a to-be-tuned ski 70 having, for example, L-shaped metal edges 72, but at a substantially right angle to the longitudinal axis of ski 70, as shown in FIG. 1. In order to be so located, arms 40 carrying side files 46 will first be moved away from the edges of ski 70. As constant-force springs 56 will normally cause arms 40 to be rotated inwardly towards one another, side files 46 will normally be located in biased contact with indented central body portion 8 which will be narrower than the narrowest part of most skis. This will normally place files 46 closer together than the narrowest width of a ski. Thus, in order to place the system on a ski, one or both arms 40 will first be rotated by the user by hand away from one another in order to move side files 46 far enough apart to accomodate the width of ski 70. This will in turn allow flat files 20 to be set against bottom 68 of upside-down ski 70. Arms 40 will then be gently released so that they will be rotated by constant torque springs 56 towards the centerline of the device. This will in turn bring side files 46 at the ends of arms 40 into contact with the edges of ski 70, including metal edges 72. Side file 46 will thus be positioned to do their work under the constant torque pressure of springs 56, and system 2 will be positioned for tuning and sharpening ski 70.

By grasping handles 14, like a jack plane, and moving system 2 longitudinally along the length of the ski from the tip to the tail, action will be provided which simultaneously smooths bottom 68 of ski 70 while sharpening edges 72. After each such stroke system 2 need not be removed from the ski, but may be pushed back towards the tip. This is accomplished by flat files 20, which will be in longitudinally moving contact with bottom base 68 of ski 70 to smooth, level and flatten the bottom 68 of ski 70 and the bottom portion of edge 72. At the same time, side files 46 will sharpen lateral edges 72 of the ski. As noted above, constant torque springs 56 will cause each arm 40 to rotate inwardly with a constant torque around pivot pins 42. This constant force is transmitted by arms 40 to side files 46 with the result that the lateral pressure exerted by side files 46 against the side edges of the skis will be constant as it is moved along the entire length of the ski regardless of the width or taper of the ski at any point, or the lateral force or speed exerted by the operator. Where the side file or other side sharpening device is circular in cross-section, the file teeth will always be presented to the edge of the ski at an angle which is correct for sharpening, regardless of the angle of arms 40. Due to the symmetry of the system it will be used with equal facility by right handed and left handed persons.

Furthermore, the action of base files 20 and side files 46 will automatically cause the bottom edges and side edges of the ski to be sharpened at a substantially 90° angle to one another, with the further result that the side edges of the ski will be parallel to one another. This action between flat base files 20 and edge files 46 will also provide a deburring action to metal edges 72 of the ski. This deburring action is unique to the present invention due to the fact that the bottom and side files both extend beyond the end of the contact with the metal edges of the ski, so that any burr in the metal will be worked on in two directions up and down. Since there will be more than one file on each 90° opposed side, any burr in the metal will be worked back and forth and will tend to break off as the system is passed longitudinally along the ski. The rotation of the system with respect to the ski will be limited during use by skew blocks 26.

Occassionally it may be desirable to tune a certain section of a ski due to excessive wear, rather than the entire ski. In such cases the user will stroke back and forth over that section of the ski numerous times. If only the bottom of the ski requires tuning, in order to prevent over tuning of the side edges, the arms may be distracted until pin holes 76 are past the outside corners of base plate 4. Then, a pin long enough to protrude past the upper surface of base plate 4, may be inserted through pin holes 76. Then when the arms are released the pins will prevent inward rotation of the arms beyond the base plate, thus preventing side files 46 from coming into contact with the ski edges. After the base is tuned the pins may be removed.

Again, in use, the tuning device of the present invention will, due to its constant torque situation, provide constant pressure on side files 46 against the lateral edges of the ski being tuned. This torque and pressure will remain constant, regardless of the variation in the lateral width of the ski, the angle of taper of the sides of the ski, or the rotation of system 2 with respect to the length of the ski. In operation, the use of this system will reduce the filing and deburring time normally required to tune a ski by as much as about twenty-five percent.

It will thus be seen that the present invention will provide the advantage of sharpening all four metal edges of a ski (two base edges and two side edges) simultaneously and equally on each stroke. The system will also automatically debur the metal edges. Since the pressure applied to the side files will be constant, the amount of side material removed during each stroke will be constant, which will allow fine control of the edge profile. As shown, the system will tune the sides at an exact 90° angle to the bottom, although the system can be modified so that the side file angle can be adjusted to a given taper, if desired.

It will be understood by one skilled in the art that sharpening devices other than files, for example, scraper bars, metal strips, machine tool bits, honing bars and the like can be used to achieve the same or similar edge sharpening results. While the file and other edge sharpening devices are preferably round, flat or curved sharpening devices can be used if pivotally mounted to maintain their working surfaces at the correct orientation to the edges of the skis.

While a simple, preferred arm pivoting system has been disclosed as a means for transmitting constant pressure from the constant torque spring to the side files, other; more complicated mechanisms may be utilized to achieve the same results. For example a constant torque spring can be connected to the sharpening device through a gear system, through a gear and pinion system, through a pulley system, or through other mechanisms to transmit the constant pressure from a constant torque spring to the sharpening device. However, in no way can a constant torque spring be connected directly to a side file or other sharpening device to resiliently urge the sharpening device against the side of a ski under constant torque.

While the invention has been particularly shown and described with reference to preferred embodiments thereof, it will be understood by those skilled in the art that the foregoing and other modifications or changes in form and details may be made therein without departing from the spirit and scope of the invention as claimed, except as precluded by the prior art.

What is claimed is:

1. A torque loaded device for tuning a ski having a bottom and a pair of opposed side edges, said device comprising in combination:

a base, said base having a top, a bottom and lateral edges;

means for producing a constant source of torque, said constant torque means being connected to and supported by said base;

a pair of symmetrical support means mounted on said base; and at least two means for sharpening the opposed side edges of a ski, said edge sharpening means being symetrically supported by and connected to said support means and extending beyond said lateral edges of said base and capable of being spaced apart a distance capable of bracketing the side edges of a ski and capable of being urged against the side edges of a ski, said edge sharpening means also being operatively connected to said constant torque means; whereby, when said device is placed on the bottom of a ski with said sharpening means bracketing the opposed side edges of a ski and freed of external forces, each of said sharpening means will be urged against the side edges of the ski with a constant pressure generated by said constant torque means.

2. The ski tuning device of claim 1 wherein said support means are a pair of arms are pivotably mounted symmetrically on said top surface of said base, each by a pivot, and a portion of said arms is capable of extending beyond said lateral edges of said base, and wherein said edge sharpening means are connected to said arms at a location spaced from said pivot and capable of extending beyond the lateral edges of said base and below the bottom of said base.

3. The ski tuning device of claim 2 wherein said edge sharpening means are substantially parallel to one another and substantially perpendicular to said bottom of said base.

4. The ski tuning device of claim 3 wherein said edge sharpening means are files.

5. The ski tuning device of claim 4 wherein said files are cylindrical in shape.

6. The device of claim 5 wherein said constant torque means is a constant-force spring.

7. The device of claim 6 wherein said constant-force spring is of the prestressed flat blade type.

8. The ski tuning device of claim 7 wherein there is at least one ski bottom smoothing tool mounted transversely across the bottom of said base.

9. The ski tuning device of claim 8 wherein said smoothing tool is substantially perpendicular to said edge sharpening mean.

10. The ski tuning device of claim 8 wherein said ski bottom smoothing tool is a flat file.

11. The ski tuning device of claim 7 wherein there are two spaced apart ski bottom smoothing tools mounted transversely across the bottom of said base.

12. The ski tuning device of claim 1 wherein there is at least one smoothing tool mounted transversely across the bottom of said base.

13. The device of claim 8 wherein a pair of skew blocks are mounted in opposed spaced apart relation on the bottom of said smoothing tool, whereby the rotation of said device on the bottom of a ski will be limited by said skew block.

14. The ski tuning device of claim 8 wherein there is at least one handle mounted on said top of said base.

15. The ski tuning device of claim 8 wherein there are two spaced apart handles mounted on said top of said base.

16. The device of claim 1 wherein said constant torque means is a constant-force spring of the prestressed flat blade type.

* * * * *